US005266451A

United States Patent [19]

Schmuck et al.

[11] Patent Number: 5,266,451

[45] Date of Patent: Nov. 30, 1993

[54] COLOR PHOTOGRAPHIC RECORDING MATERIAL

[75] Inventors: Arno Schmuck, Leichlingen; Manfred Peters, Leverkusen; Helmut Kampfer, Fischbach; Wolfgang Schmidt, Bergisch Gladbach, all of Fed. Rep. of Germany

[73] Assignee: Agfa Gevaert Aktiengesellschaft, Leverkusen, Fed. Rep. of Germany

[21] Appl. No.: 878,168

[22] Filed: May 4, 1992

[30] Foreign Application Priority Data

May 16, 1991 [DE] Fed. Rep. of Germany ..... 4115972
Jul. 17, 1991 [DE] Fed. Rep. of Germany ..... 4123601

[51] Int. Cl.[5] ..... G03C 1/08

[52] U.S. Cl. ..... 430/509; 430/506; 430/507; 430/505; 430/504

[58] Field of Search ..... 430/509, 506, 507, 505, 430/504

[56] References Cited

U.S. PATENT DOCUMENTS 4,751,174 6/1988 Toya ..... 430/506
4,752,558 6/1988 Shimura et al. ..... 430/509
4,806,460 2/1989 Ogawa et al. ..... 430/504
4,902,609 2/1990 Hahm ..... 430/504
4,946,765 8/1990 Hahm ..... 430/504

FOREIGN PATENT DOCUMENTS 0304297 2/1989 European Pat. Off. .
0356077 2/1990 European Pat. Off. .
2137372 10/1984 United Kingdom ..... 430/506

*Primary Examiner*—Charles L. Bowers, Jr.
*Assistant Examiner*—Thomas R. Neville
*Attorney, Agent, or Firm*—Connolly and Hutz

[57] ABSTRACT

A color photographic recording material with a reflective support which contains a spectrally sensitized silver halide emulsion containing at least one sensitizer for the spectral region B in a layer free from color coupler adjacent at least one dye-producing silver halide emulsion layer sensitized for the spectral region A, the sensitivity of the spectrally sensitized silver halide emulsion of the layer free from color coupler being lower by 0.6 to 2.5 log H units than the sensitivity of the sensitized silver halide emulsion of the dye-producing silver halide emulsion layer, is distinguished by an extended gradation range in the region of the maximum densities and, hence, by distinctly improved fine detail resolution at high densities.

9 Claims, No Drawings

COLOR PHOTOGRAPHIC RECORDING MATERIAL

This invention relates to a color photographic recording material with a reflective support having an extended gradation range in the region of the maximum densities and, hence, distinctly improved fine detail resolution at high densities.

Inadequate differentiation in the red tones is a weakness of most commercially available color negative papers. This weakness is particularly noticeable where films having very high inter-image effects and very high color saturation are used and subsequently copied onto conventional color negative paper.

According to EP 304 297, a certain improvement in this weakness is obtained if, in a color photographic material comprising first and second silver halide emulsion layers, which are sensitized for first and second regions of the visible spectrum and contain color couplers, the second emulsion layer is also sensitized to a limited extent for the first region of the visible spectrum. If, for example, the red-sensitive layer additionally contains a green sensitizer, 15 visible steps instead of the previous 11 are developed in the magenta region. Similar solutions are described in EP 368 271 and in U.S. Pat. No. 4,806,460.

As already described, a secondary density of another color, for example cyan, is produced by this measure, for example in the magenta region, albeit only in regions of high density. In regions of high red density, the eye does not perceive this secondary color density as color falsification, but rather as deepening of the main color. However, the measure in question can only be used for red tones without color falsification actually becoming visible. The number of gradation steps additionally obtained remains inadequate.

Another method of improving differentiation at high color densities is described in EP 356 077. In this case, a color coupler is provided in a non-photosensitive interlayer between two photosensitive silver halide emulsion layers. The exposure range of the first layer is extended if, depending on the development, the color coupler in the interlayer forms a dye complementary to the color of the first layer. Accordingly, there is a gradual increase in a secondary density over the entire gradation range. This increase is proportional to the increase in the secondary density of the photosensitive layer and leads to unwanted color falsification.

The problem addressed by the present invention was to provide a color photographic material with a reflective support which would have an extended gradation range for the color separations in the region of the maximum densities and, hence, distinctly improved resolution of fine detail at high densities, which in addition would be distinguished by high color purity and of which the gradation in the shadow parts could be made flat or steep as required without any change in the gradation of the actual dye-producing layer.

According to the invention, the solution to this problem is characterized in that a spectrally sensitized silver halide emulsion containing at least one sensitizer for the spectral region B is provided in a layer free from color coupler ("sensilayer") adjacent at least one dye-producing silver halide emulsion layer sensitized for the spectral region A, the sensitivity of the spectrally sensitized silver halide emulsion of the sensilayer being lower by 0.6 to 2.5 log H units than the sensitivity of the sensitized silver halide emulsion of the dye-producing silver halide emulsion layer.

The sensilayer is provided in particular as an interlayer between two dye-producing silver halide emulsion layers respectively sensitized for the spectral regions A and B. In this case, it preferably contains both a sensitizer for the spectral region A and a sensitizer for the spectral region B.

The dye-producing layers are preferably green- and red-sensitized and contain the complementary couplers, namely magenta and cyan couplers, in the usual way.

The solution provided by the present invention is further characterized in that, of the interlayers free from color couplers between three dye-producing silver halide emulsion layers sensitized for the spectral regions A, B and C, the interlayer between A and B contains at least one spectrally sensitized silver halide emulsion which contains at least one sensitizer or at least one of the regions A, B or C and the interlayer between B and C contains at least one spectrally sensitized silver halide emulsion containing at least one sensitizer for at least one of the regions A, B or C, the sensitivity of the spectrally sensitized silver halide emulsions of the interlayers free from color couplers being lower by 0.6 to 2.5 log H units than the sensitivity of the sensitized silver halide emulsions of the dye-producing silver halide emulsion layers.

The interlayer between the silver halide emulsion layers sensitized for the spectral regions A and B preferably contains both a sensitizer for the spectral region A or B and a sensitizer for the spectral region C.

The interlayer between the silver halide emulsion layers sensitized for the spectral regions B and C preferably contains both a sensitizer for the spectral region B or C and a sensitizer for the spectral region A.

The dye-producing layers are preferably red-, green- and blue-sensitized and contain the complementary couplers, namely cyan, magenta and yellow couplers, in the usual way.

The sensilayers may also be arranged above or below the dye-producing silver halide emulsion layers.

A sensilayer is understood to be a layer which does not contain any couplers that contribute solely towards the color buildup of the image. However, the sensilayer may contain compounds which, in an imagewise coupling reaction, release photographically active groups, such as development inhibitors and development accelerators, so-called DIR or DAR couplers, and also DIR or DAR compounds in the typical effective quantities. The latter compounds do not produce a dye during the coupling reaction.

The sensilayer may otherwise contain typical constituents of an interlayer, for example binders and so-called DOP trappers, i.e. substances which react with the developer oxidation product to form stable colorless substances, and also scavengers which reduce DOP.

In a particularly preferred embodiment, the material according to the invention is a material which comprises at least one blue-sensitive silver halide emulsion layer containing at least one yellow coupler, an interlayer, at least one green-sensitive silver halide emulsion layer containing at least one magenta coupler, and interlayer, at least one red-sensitive silver halide emulsion layer containing at least one cyan coupler and at least one protective layer in that order on a reflective support and which is characterized in that the interlayer between the green-sensitive and the red-sensitive silver halide emulsion layer and the interlayer between the blue-sensitive and the green-sensitive silver halide emulsion layer—independently of one another—are designed in accordance with the invention and contain either a green-sensitized or a red-sensitized or a blue-sensitized or a green- and red-sensitized or a red- and blue-sensitized or a green- and blue-sensitized or a green- and red- and blue-sensitized silver halide emulsion.

In a particularly preferred embodiment, both interlayers of the material described in the preceding paragraph are red-, green- and blue-sensitized.

AgBr, AgBrCl, AgBrClI and AgCl may be used as the silver halides of the silver halide emulsion layers free from color couplers and those containing color couplers.

The silver halides of all the photosensitive layers, including the interlayers according to the invention, preferably contain at least 80 mol-% chloride and more particularly 95 to 100 mol-% chloride, 0 to 5 mol-% bromide and 0 to 1 mol-% iodide. The silver halide emulsions may be direct-positive emulsions or, preferably, negative emulsions.

The silver halide may consist of predominantly compact crystals which may have, for example, a regular cubic or octahedral form or transitional forms. However, the silver halide may also consist with advantage of twinned, i.e. platelet-like, crystals of which the average diameter-to-thickness ratio is preferably at least 5:1, the diameter of a crystal being defined as the diameter of a circle with an area corresponding to the projected area of the crystal. However, the layers may also contain platy silver halide crystals in which the diameter-to-thickness ratio is greater than 5:1, for example from 12:1 to 30:1.

The silver halide grains may also have a multiple-layer grain structure, in the most simple case with an inner and an outer core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G.F. Duffin, Photographic Emulsion Chemistry, The Focal Press, London (1966); V.L. Selikman et al, Making and Coating Photographic Emulsion, The Focal Press, London (1966)).

Precipitation of the silver halide is preferably carried out in the presence of the binder, for example gelatine, in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which no nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Precipitation of the silver halide grains may be carried out in the presence of growth modifiers, i.e. substances which influence growth in such a way that special grain forms and grain surfaces (for example 111-surfaces in the case of AgCl) are formed.

Silver halide grains containing metal ions, particularly transition metal ions or complexes thereof, inside the grain or on the surface are preferably used for the interlayer according to the invention. Salts or complexes of Cd, Zn, Pb, Tl, Bi, Ir, Rh, Fe, Pt, Pd, Ru or Os are preferably used for doping the silver halides. The sensitivity and contrast of the interlayer can be specifically adjusted in this way.

In addition, precipitation may even be carried out in the presence of sensitizing dyes. Complexing agents and/or dyes may be inactivated at any time, for example by changing the pH value or by an oxidative treatment.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. The production of such gelatines is described, for example, in The Science and Technology of Gelatine, edited by A.G. Ward and A. Courts, Academic Press 1977, pages 295 et seq. The particular gelatine used should contain as few photographically active impurities as possible (inert gelatine). Gelatines of high viscosity and low swelling are particularly advantageous. The gelatine may be completely or partly oxidized.

On completion of crystal formation or even at an earlier step, the soluble salts are removed from the emulsion, for example by noodling and washing, by flocculation and washing, by ultrafiltration or by ion exchangers.

The photographic emulsions may contain compounds to prevent fogging or to stabilize the photographic function during production, storage and photographic processing.

Particularly suitable compounds of this type are azaindenes, preferably tetra- and pentaazaindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, (substituted) benztriazoles or benzthiazolium salts. Heterocycles containing mercapto groups are particularly suitable, examples of such compounds being mercaptobenzthiazoles, mercaptobenzimidazoles,mercaptotetrazoles,mercaptothiadiazoles, mercaptopyrimidines; these mercaptoazoles may even contain a water-solubilizing group, for example a carboxyl group or sulfo group. Other suitable compounds are published in Research Disclosure no. 17643 (1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The silver halide emulsions are normally chemically ripened, for example by the action of gold compounds or compounds of divalent sulfur.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.).

Suitable sensitizing dyes are cyanine dyes, more particularly those belonging to the following classes:

1. Red Sensitizers

Dicarbocyanines with naphthothiazole or benzthiazole as basic terminal groups, which may be substituted in the 5- and/or 6-position by halogen, methyl, methoxy, and also 9,11-alkylene-bridged, more particularly 9,11-neopentylene thiadicarbocyanines bearing alkyl or sulfoalkyl substituents at nitrogen.

2. Green Sensitizers

9-Ethyloxacarbocyanines substituted in the 5-position by chlorine or phenyl and bearing alkyl or sulfoalkyl substituents, preferably sulfoalkyl substituents, at the nitrogen.

3. Blue Sensitizers

Methine cyanines containing benzoxazole, benzthiazole, benzselenazole, naphthoxazole, naphthoxazole, naphthothiazole as basic terminal groups which are substituted in the 5- and/or 6-position by halogen, methyl, methoxy and which bear at least one and preferably two sulfoalkyl substituents at the nitrogen; also apomerocyanines containing a thiocyanine group.

There is no need for sensitizers if the natural sensitivity of the silver halide for a certain spectral region, for example the blue sensitivity of silver bromide iodides, is sufficient.

Non-diffusing monomeric or polymeric color couplers are associated with the differently sensitized emulsion layers and may be arranged in the same layer or in an adjacent layer. Cyan couplers are normally associated with the red-sensitive layers, magenta couplers with the green-sensitive layers and yellow couplers with the blue-sensitive layers.

Color couplers for producing the cyan component dye image are generally couplers of the phenol or α-naphthol type.

Color couplers for producing the magenta component dye image are generally couplers of the 5-pyrazolone, indazolone or pyrazoloazole type.

Color couplers for producing the yellow component dye image are generally couplers containing an open-chain ketomethylene group, more especially couplers of the α-acyl acetamide type, of which suitable examples are α-benzoyl acetanilide couplers and α-pivaloyl acetanilide couplers.

The color couplers may be 4-equivalent couplers and also 2-equivalent couplers. 2-Equivalent couplers are derived from the 4-equivalent couplers in that they contain in the coupling position a substituent which is eliminated during the coupling reaction.

The couplers normally contain a ballast group to prevent diffusion within the material, i.e. both within one and the same layer or from layer to layer. Instead of couplers containing a ballast group, high molecular weight couplers may also be used.

Suitable color couplers and literature references where they are described can be found in Research Disclosure 17 643 (1978), Chapter VII.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. No. 2,322,027, U.S. Pat. No. 2,801,170, U.S. Pat. No. 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecylbenzene and diisopropyl naphthalene.

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight and, on the other hand, as filter dyes to absorb the UV component of daylight on exposure and thus to improve the color resolution of a film. Compounds of different structure are normally used for the two functions. Examples are aryl-substituted benzotriazole compounds (U.S. Pat. No. 3,533,794), 4-thiazolidone compounds (U.S. Pat. No. 3,314,794 and 3,352,681), benzophenone compounds (JP-A-2784/71), cinnamic acid ester compounds (U.S. Pat. No. 3,704,805 and 3,707,375), butadiene compounds (U.S. Pat. No. 4,045,229) or benzoxazole compounds (U.S. Pat. No. 3,700,455).

It is also possible to use UV-absorbing couplers (such as cyan couplers of the $\alpha$-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in U.S. Pat. No. 2,632,701 and 3,269,840 and in GB-A-852,075 and 1,319,763.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643, December 1978, Chapter XVI).

The mean particle diameter of the spacers is particularly in the range from 0.2 to 10 $\mu$m. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643/1978, Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment (deterioration or degradation) of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment (deterioration or degradation) of magenta-red dye images, particularly their impairment as a result of the effect of light.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. No. 3,288,775, U.S. Pat. No. 2,732,303, GB-A-974,723 and GB-A-1,167,207), divinylsulfone compounds, 5-acetyl-1,3-diacryloyl hexahydro-1,3,5-triazine and other compounds containing a reactive olefin bond (U.S. Pat. No. 3,635,718, U.S. Pat. No. 3,232,763 and GB-A-994,869); N-hydroxymethyl phthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,017,280 and U.S. Pat. No. 2,983,611); acid derivatives (U.S. Pat. No. 2,725,294 and U.S. Pat. No. 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat. No. 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and cross-linking of the gelatine.

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

The color photographic materials according to the invention are normally processed by development, bleaching, fixing and washing or stabilization without subsequent washing; bleaching and fixing may be combined into a single processing step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methanesulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

The color photographic material according to the invention may also be subjected to reversal development. In this case, color development is preceded by a first development with a developer which does not form a dye with the couplers, and diffuse second exposure or chemical fogging. In this case, it is best to select a silver halide emulsion of which the sensitivity is higher, more particularly by 0.6 to 2.5 log H units, than the sensitivity of the dye-producing layer as the silver halide emulsion for the layer free from color coupler adjacent at least one dye-producing silver halide emulsion layer. The material according to the invention is preferably subjected to negative development.

EXAMPLES

A color photographic recording material suitable for high-speed processing was produced by application of the following layers in succession to a paper coated on both sides with polyethylene. The quantities shown are all based on 1 $m^2$. For the silver halide applied, the corresponding quantities of $AgNO_3$ are shown.

EXAMPLE 1

Layer Arrangement 1

1st layer (substrate layer)
- 0.2 g gelatine

2nd layer (blue-sensitive layer)
- blue-sensitive silver halide emulsion (99.5 mol-% chloride, 0.5 mol-% bromide, average grain diameter 0.78 μm) of 0.50 g $AgNO_3$ containing
- 1.38 g gelatine
- 0.60 g yellow coupler Y-1
- 0.48 g tricresyl phosphate (TCP)

3rd layer (interlayer)
- 1.18 g gelatine
- 0.08 g 2,5-dioctyl hydroquinone
- 0.08 g dibutyl phthalate (DBP)

4th layer (green-sensitive layer)
- green-sensitized silver halide emulsion (99.5 mol-% chloride, 0.5 mol-% bromide, average grain diameter 0.37 μm) of 0.40 g $AgNO_3$ containing
- 1.02 g gelatine
- 0.37 g magenta coupler M-1
- 0.40 g DBP 5th layer (interlayer)
- 1.20 g gelatine
- 0.66 g UV absorber corresponding to the formula

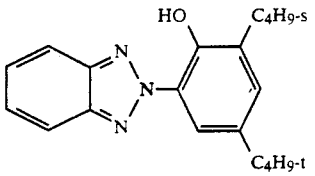

0.052 g 2,5-dioctyl hydroquinone
0.36 g TCP

6th layer (red-sensitive layer)
red-sensitized silver halide emulsion (99.5 mol-% chloride, 0.5 mol-% bromide, average grain diameter 0.35 μm) of 0.28 g $AgNO_3$ containing
0.84 g gelatine
0.39 g cyan coupler C-1
0.39 g TCP 7th layer (UV-absorbing layer)
0.65 g gelatine
0.21 g UV absorber as in layer 5
0.11 g TCP 8th layer (protective layer)
0.65 g gelatine
0.39 g hardener corresponding to the formula

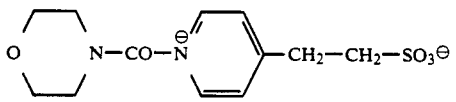

EXAMPLE 2

Comparison

A color photographic recording material was produced in the same way as described in Example 1 except that layer 5 contained 1.90 g gelatine and, in addition, 0.1 g magenta coupler M-1.

EXAMPLE 3

Comparison

A color photographic recording material was produced in the same way as described in Example 1, except that the red-sensitive emulsion in layer 6 was additionally green-sensitized with GS 1 (50 μmol/mol Ag).

EXAMPLE 4

Invention

A color photographic recording material was produced in the same way as described in Example 1, except that layer 5 contained an additional green-sensitive silver halide emulsion (99.5 mol-% chloride, 0.5 mol-% bromide, average grain diameter 0.14 μm) of 0.28 g $AgNO_3$ which had been sensitized with 30 mg GS 1/100 g $AgNO_3$.

A green-exposed color separation wedge was prepared from this material and processed by the described method.

The comparison materials of Examples 1 and 2 develop 17 visible steps in the magenta whereas the material according to Example 3 develops 15 visible steps and the material according to the invention 21 visible steps. Accordingly, the material according to the invention has an extended gradation range and better differentiation at high magenta densities than the comparison materials of Examples 1 to 3 and greater color purity at high densities than the comparison material of Example 3.

The comparison materials and the material according to the invention were exposed with a color negative (image motif) and processed by the described method. The material according to the invention shows significantly better fine detail resolution at high red densities than the comparison materials of Examples 1 to 3 and less color falsification at high magenta densities than the comparison material of Example 3.

EXAMPLE 5

Invention

A color photograhic recording material was produced in the same way as described in Example 1, except that layer 5 contained an additional red-sensitive silver halide emulsion (99.5 mol-% chloride, 0.5 mol-% bromide, mean grain diameter 0.14 μm) of 0.28 g $AgNO_3$ which had been sensitized with 20 mg RS1/100 g $AgNO_3$.

A red-exposed color separation wedge was prepared from this material and processed by the described method.

The comparison material of Example 1 develops 14, the comparison material of Example 2 15 and the comparison material of Example 3 14 visible steps in the cyan whereas the material according to the invention develops 20 visible steps in the cyan. Accordingly, the material according to the invention has an extended gradation range and better differentiation at high color densities than the comparison materials of Examples 1 to 3. In contrast to the comparison material of Example 2, the material according to the invention does not show any discernible color shift from cyan to blue in the linear gradation range.

The comparison material and the material according to the invention were exposed with a color negative (image motif) and processed by the described method. The material according to the invention shows significantly better fine detail resolution at high green densities than the comparison material of Example 2 and no shift of the green tones towards blue.

EXAMPLE 6

Invention

A color photographic recording material was produced in the same way as the comparison material described in Example 1, except that layer 5 contained an additional red- and green-sensitive silver halide emulsion (99.5 mol-% chloride, 0.5 mol-% bromide, average grain diameter 0.14 μm) of 0.28 g $AgNO_3$ which had been sensitized with 30 mg GS1/100 g $AgNO_3$ and 20 mg RS1/100 g $AgNO_3$.

A red-exposed and a green-exposed color separation wedge were prepared from this material and processed by the described method.

The comparison material of Example 2 develops 15 visible steps in the cyan and 17 visible steps in the magenta, the comparison material of Example 3 develops 14 visible steps in the cyan and 15 visible steps in the magenta and the material according to the invention develops 20 visible steps in the cyan and 21 visible steps in the magenta. Accordingly, the material according to the invention has an extended gradation range and better differentiation at high magenta and cyan densities coupled with greater color purity in the linear gradation range than the comparison material of Example 2 and greater color purity at high magenta densities than the comparison material of Example 3.

The comparison material and the material according to the invention were exposed with a color negative (image motif) and processed by the described method. The material according to the invention shows significantly better fine detail resolution at high densities coupled with greater color purity in the red, green and blue and also magenta and cyan than the comparison materials of Examples 2 and 3.

EXAMPLE 7

Invention

A color photographic recording material was produced in the same way as the comparison material described in Example 1, except that layer 3 contained an additional red-, blue- and green-sensitive silver halide emulsion (99.5 mol-% chloride, 0.5 mol-% bromide, average grain diameter 0.35 μm) of 0.28 g $AgNO_3$ which had been sensitized with 10 mg GS1/100 g $AgNO_3$ and with 5 mg RS1 and 65 mg BS1/100 g $AgNO_3$ and layer 5 contained an additional red-, blue- and green-sensitive silver halide emulsion (99.5 mol-% chloride, 0.5 mol-% bromide, average grain diameter 0.35 μm) of 0.28 g $AgNO_3$ which had been sensitized with 20 mg GS1/100 g $AgNO_3$ and with 70 mg BS1 and 15 mg RS1/100 g $AgNO_3$.

A red-exposed, a green-exposed and a blue-exposed color separation wedge were prepared from this material and processed by the described method.

The comparison material of Example 1 develops 15 visible steps in the yellow, 17 visible steps in the magenta and 14 visible steps in the cyan, the comparison material of Example 2 develops 15 visible steps in the yellow, 17 visible steps in the magenta and 15 visible steps in the cyan, the comparison material of Example 3 develops 15 visible steps in the yellow, 20 visible steps in the magenta and 14 visible steps in the cyan and the material according to the invention develops 22 visible steps in the yellow, 21 visible steps in the magenta and 20 visible steps in the cyan. Accordingly, the material according to the invention has an extended gradation range and better differentiation at high magenta, cyan and yellow color densities than the comparison materials of Examples 1, 2 and 3 without any adverse effect on grey balance. The comparison material and the material according to the invention were exposed with a color negative (image motif) and processed by the described method. The material according to the invention shows significantly better fine detail resolution at high densities in the red, green and blue regions and in the yellow, magenta and cyan regions coupled with greater color purity than the comparison materials of Examples 1, 2 or 3.

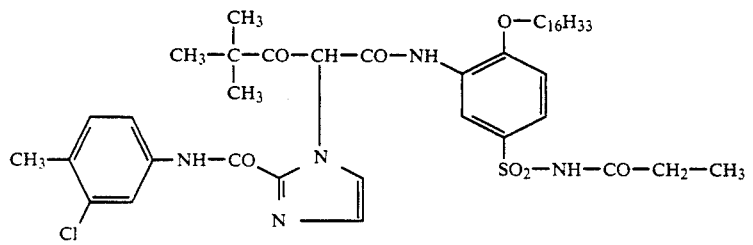

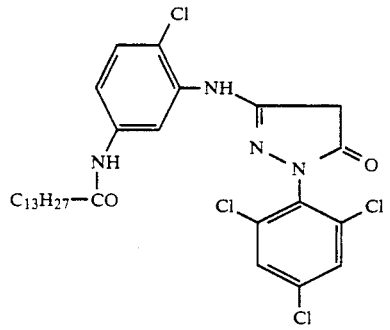

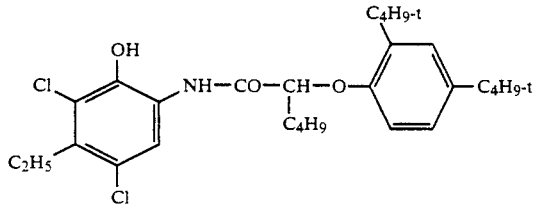

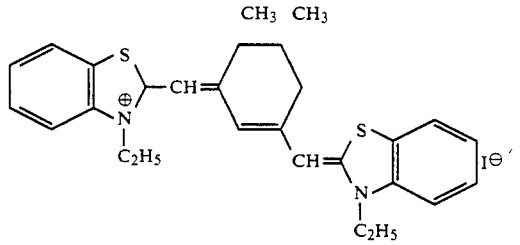

-continued

Sensitization maximum: 708 nm

BS-1

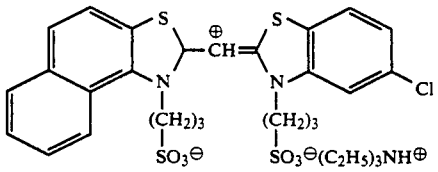

Sensitization maximum: 480 nm

GS-1

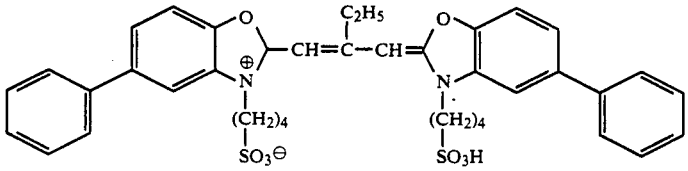

Sensitization maximum: 545 nm

| | | |
|---|---|---|
| a) | Color developer - 45 s - 35° C. | |
| | Triethanolamine | 9.0 g/l |
| | N,N-diethyl hydroxylamine | 4.0 g/l |
| | Diethylene glycol | 0.05 g/l |
| | 3-Methyl-4-amino-N-ethyl-N-methane sulfonamidoethyl aniline sulfate | 5.0 g/l |
| | Potassium sulfite | 0.2 g/l |
| | Triethylene glycol | 0.05 g/l |
| | Potassium carbonate | 22 g/l |
| | Potassium hydroxide | 0.4 g/l |
| | Ethylenediamine tetraacetic acid di-Na salt | 2.2 g/l |
| | Potassium chloride | 2.5 g/l |
| | 1,2-Dihydroxybenzene-3,4,6-trisulfonic acid trisodium salt | 0.3 g/l |
| | Make up with water to 1,000 ml; pH 10.0 | |
| b) | Bleaching/fixing bath - 45 s - 35° C. | |
| | Ammonium thiosulfate | 75 g/l |
| | Sodium hydrogen sulfite | 13.5 g/l |
| | Ammonium acetate | 2.0 g/l |
| | Ethylenediamine tetraacetic acid (iron ammonium salt) | 57 g/l |
| | Ammonia, 25% by weight | 9.5 g/l |
| | Acetic acid | 9.0 g/l |
| | Make up with water to 1,000 ml; pH 5.5 | |
| c) | Rinsing - 2 mins. - 33° C. | |

EXAMPLE 8

Comparison

A layer support of paper coated on both sides with polyethylene was provided with the following layers. The quantities all based on 1 $m^2$.

1. A substrate layer of 200 mg gelatine containing additions of $KNO_3$ and chrome alum
2. A binding layer of 320 mg gelatine
3. A blue-sensitive silver bromide chloride emulsion layer (2 mol-% chloride) of 450 mg $AgNO_3$ containing 1,600 mg gelatine, 1.0 mmol yellow coupler Y-2, 27.7 mg 2,5-dioctyl hydroquinone and 650 mg tricresyl phosphate
4. An interlayer of 1,200 mg gelatine, 80 mg 2,5-dioctyl hydroquinone and 100 mg tricresyl phosphate
5. A green-sensitive silver bromide chloride emulsion layer (20 mol-% chloride) of 530 mg $AgNO_3$ containing 750 mg gelatine, 0.625 mmol magenta coupler M-1, 43 mg 2,5-dioctyl hydroquinone, 343 mg dibutyl phthalate and 43 mg tricresyl phosphate
6. 1st UV layer of 1,550 mg gelatine, 500 mg of the same UV absorber as in Example 1, 5th layer, 80 mg dioctyl hydroquinone and 650 mg tricresyl phosphate
7. A red-sensitive silver bromide chloride emulsion layer (20 mol-% chloride) of 400 mg $AgNO_3$ containing 1,470 mg gelatine, 0.780 mmol cyan coupler C-1, 285 mg dibutyl phthalate and 122 mg tricresyl phosphate
8. 2nd UV layer of 400 mg gelatine, 134 mg of the same UV absorber as in example 1, 5th layer, and 240 mg tricresyl phosphate
9. A protective layer of 1,200 mg gelatine and 400 mg hardener corresponding to the following formula

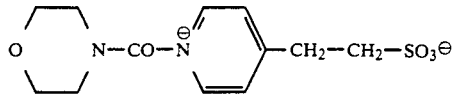

-continued

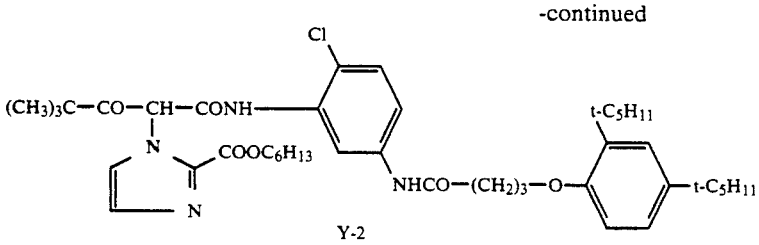

Y-2

EXAMPLE 9

Invention

A color photographic recording material was prepared in the same way as the comparison material described in Example 8, except that the 6th layer contained an additional red- and green-sensitive silver halide emulsion (silver bromide chloride emulsion containing 20 mol-% chloride) of 0.40 g $AgNO_3$ which had been sensitized with 25 mg GS1/100 g $AgNO_3$ and 18 mg RS1/100 g $AgNO_3$.

A red-exposed and a green-exposed color separation wedge were prepared from this material and processed by the described method.

The comparison material of Example 8 develops 17 visible steps in the cyan and 16 visible steps in the magenta while the material according to the invention develops 20 visible steps in the cyan and 20 visible steps in the magenta. Accordingly, the material according to the invention has an extended gradation range and better differentiation at high magenta and cyan color densities than the comparison material of Example 8.

The comparison material and the material according to the invention were exposed with a color negative (image motif) and processed by the described method. The material according to the invention shows significantly better fine detail resolution at high densities in the red, green and blue and in the magenta and cyan than the comparison material of Example 8.

| | | |
|---|---|---|
| Color developer | 33° C. | 3.5 minutes |
| Bleaching/fixing bath | 33° C. | 1.5 minutes |
| Rinsing | 33° C. | 3.0 minutes |

The processing baths were prepared in accordance with the following formulations:

| Developer | |
|---|---|
| 900 ml | water |
| 15 ml | benzyl alcohol |
| 15 ml | ethylene glycol |
| 3 g | hydroxyl amine sulfate |
| 4.5 g | 3-methyl-4-amino-N-ethyl-N-(β-methanesulfonamido-ethyl)-aniline sulfate |
| 32 g | potassium carbonate sicc. |
| 2 g | potassium sulfite sicc. |
| 0.6 g | potassium bromide |
| 1 g | disodium salt of 1-hydroxyethylidine-1,1-diphosphonic acid |

make up with water to 1 liter and adjust to pH 10.2.

| Bleaching/fixing bath | |
|---|---|
| 700 ml | water |
| 35 ml | ammonia solution (28% by weight) |
| 30 g | ethylenediamine-N,N,N',N'-tetraacetic acid |
| 15 g | sodium sulfite sicc. |

-continued

| Bleaching/fixing bath | |
|---|---|
| 100 g | ammonium thiosulfate sicc. |
| 60 g | sodium (ethylenediaminetetraacetate) iron(III) complex |

make up with water to 1 liter and adjust to pH 7.

We claim:

1. A color photographic recording material with a reflective support comprising three dye-producing silver halide emulsion layers sensitized for the spectral regions A, B and C and interlayers free from color couplers, characterized in that the interlayer between A and B contains at least one spectrally sensitized silver halide emulsion containing at least one sensitizer for at least one of the regions A, B or C and the interlayer between B and C contains at least one spectrally sensitized silver halide emulsion containing at least one sensitizer for at least one of the regions A, B or C, the sensitivity of the spectrally sensitized silver halide emulsions of the interlayers free from color couplers being lower by 0.6 to 2.5 log H units than the sensitivity of the sensitized silver halide emulsions of the dye-producing silver halide emulsion layers.

2. A color photographic recording material as claimed in claim 1, characterized in that the interlayer between the silver halide emulsion layers sensitized for the spectral regions A and B contains both a sensitizer for the spectral region A or B and a sensitizer for the spectral region C.

3. A color photographic recording material as claimed in claim 1, characterized in that the interlayer between the silver halide emulsion layers sensitized for the spectral regions B and C contains both a sensitizer for the spectral region B or C and a sensitizer for the spectral region A.

4. A color photographic recording material as claimed in claim 1, characterized in that the spectral regions A, B and C stand in any order for the red, green and blue spectral regions.

5. A color photographic recording material with a reflective support which contains a spectrally sensitized silver halide emulsion containing at least one sensitizer for a spectral region B in a layer free from color coupler adjacent at least one dye-producing silver halide emulsion layer sensitized for the spectral region A, the sensitivity of the spectrally sensitized silver halide emulsion of the layer free from color coupler being lower by 0.6 to 2.5 log H units than the sensitivity of the sensitized silver halide emulsion of the dye-producing silver halide emulsion layer, wherein the spectral regions A and B stand in any order for the red, green and blue spectral regions and the silver halides of all the photosensitive layers, contain at least 80 mol-% of silver chloride.

6. A color photographic recording material as claimed in claim 5, characterized in that the layer free from color coupler is an interlayer between two dye-producing silver halide emulsion layers sensitized for the spectral regions A and B.

7. A color photographic recording material as claimed in claim 6, characterized in that the interlayer free from color coupler contains both a sensitizer for the spectral region A and a sensitizer for the spectral region B.

8. A color photographic recording material as claimed in claim 5, characterized in that the spectral regions A and B are the green and red or red and green spectral regions.

9. A color photographic recording material as claimed in claim 5, characterized in that the silver halides of all the photosensitive layers, including the interlayers, contain 95 to 100 mol-% chloride, 0 to 5 mol-% bromide and 0 to 1 mol-% iodide.

* * * * *